US007563751B2

(12) United States Patent
Yagishita

(10) Patent No.: US 7,563,751 B2
(45) **Date of Patent: *Jul. 21, 2009**

(54) LUBRICATING OIL COMPOSITION

(75) Inventor: Kazuhiro Yagishita, Kanagawa (JP)

(73) Assignee: Nippon Oil Corporation, Tokyo (JP)

( * ) Notice: Subject to any disclaimer, the term of this patent is extended or adjusted under 35 U.S.C. 154(b) by 506 days.

This patent is subject to a terminal disclaimer.

(21) Appl. No.: 10/523,566

(22) PCT Filed: Aug. 5, 2003

(86) PCT No.: PCT/JP03/09952

§ 371 (c)(1),
(2), (4) Date: Feb. 3, 2005

(87) PCT Pub. No.: WO2004/013263

PCT Pub. Date: Feb. 12, 2004

(65) Prior Publication Data

US 2005/0272616 A1 Dec. 8, 2005

(30) Foreign Application Priority Data

Aug. 5, 2002 (JP) ..... 2002-227530

(51) Int. Cl.
*C10M 159/22* (2006.01)

(52) U.S. Cl. ..... 508/460

(58) Field of Classification Search ..... 508/175, 508/440, 460; 356/407, 409, 432, 434; 436/73, 436/74, 75, 177, 175; 210/752, 759, 902; 423/87

See application file for complete search history.

(56) References Cited

U.S. PATENT DOCUMENTS

| | | | | |
|---|---|---|---|---|
| 5,380,508 | A * | 1/1995 | Inoue | 423/286 |
| 5,415,792 | A * | 5/1995 | Campbell | 508/459 |
| 5,458,807 | A * | 10/1995 | Tamoto | 508/192 |
| 5,652,201 | A * | 7/1997 | Papay et al. | 508/228 |
| 6,159,911 | A * | 12/2000 | Katafuchi | 508/391 |
| 6,162,769 | A * | 12/2000 | Polhaar et al. | 508/339 |
| 6,569,818 | B2 * | 5/2003 | Nakazato et al. | 508/185 |
| 6,656,887 | B2 | 12/2003 | Yagishita et al. | |
| 2002/0082176 | A1 * | 6/2002 | Chambard et al. | 508/371 |
| 2003/0220209 | A1 * | 11/2003 | Curtis et al. | 508/551 |

FOREIGN PATENT DOCUMENTS

| | | | |
|---|---|---|---|
| EP | 0 957 153 | A1 | 11/1999 |
| EP | 1 227 145 | A1 | 7/2002 |
| EP | 1 338 643 | | 8/2003 |
| EP | 1 526 169 | | 4/2005 |
| EP | 1 526 170 | | 4/2005 |
| GB | 1 146 925 | | 3/1969 |
| GB | 1 184 020 | | 3/1970 |
| JP | 48-035325 | | 10/1973 |
| JP | 50-003082 | | 1/1975 |
| JP | 5-311187 | | 11/1993 |
| JP | 10-183154 | | 7/1998 |
| JP | 2002015351 | | 1/2002 |
| JP | 2002-212579 | | 7/2002 |
| JP | 2002-294271 | | 10/2002 |
| JP | 2002-294271 | A | 10/2002 |
| WO | WO 96/37582 | | 11/1996 |
| WO | WO 00/63325 | | 10/2000 |

* cited by examiner

*Primary Examiner*—Glenn Caldarola
*Assistant Examiner*—Jim Goloboy
(74) *Attorney, Agent, or Firm*—Ladas & Parry LLP

(57) ABSTRACT

The present invention provides a lubricating oil composition, comprising: a lubricant base oil having a sulfur content adjusted to 0.1% or less by mass; and (A) one or more alkali metal or alkaline earth metal salicylates in which the ratio of a salicylate constituent having, in the 3- and 5-positions, hydrocarbon groups having 1 to 40 carbon atoms is adjusted to 10% or more by mol and/or (B) one or more alkali metal or alkaline earth metal salicylates in which the ratio of one or more monoalkylsalicylate constituents is adjusted to 85% or more by mol and the ratio of a monoalkylsalicylate constituent having, in the 3-position, a secondary alkyl group having 10 or more and less than 20 carbon atoms is adjusted to 50% or more by mol, the (A) and/or (B) being incorporated into the base oil in an amount of 0.005 to 5% by mass of the total of the composition, and the amount being an amount in terms of the metal element therein. In this way, the oxidation life under the contamination of water content is improved.

10 Claims, No Drawings

LUBRICATING OIL COMPOSITION

TECHNICAL FIELD

The present invention relates to a lubricating oil composition, specifically, a lubricating oil composition which is excellent in oxidation stability under the contamination of water content and is suitable for internal combustion engines.

BACKGROUND ART

Conventionally, it has been considered that the oxidation deterioration of lubricating oil is promoted under high temperature conditions. In recent years, however, attention has been paid to the fact that under the conditions that the oil is present together with water content the deterioration is promoted at relatively low temperature also (IGARASHI, Tribologist, vol. 45, No. 11, (2000), pp. 801-808). It appears that the oxidation deterioration of lubricating oil for internal combustion engines at low temperature is caused by the following: water vapor generated by combustion in an engine or water content in air condenses so as to be incorporated into the lubricating oil; when this remains and accumulates in the lubricating oil without evaporating, the oxidation deterioration is promoted; and then water reacts with sulfur compounds, such as sulfur oxides contained in combustion gas or zinc dithiophosphate contained in the lubricating oil, decomposition products thereof, and other compounds so as to generate strong acids such as sulfuric acid. A metal detergent has effect of neutralizing such strong acids, and is used to heighten the high-temperature detergency of lubricating oil. However, when the metal detergent itself is used up for the neutralization, the oxidation deterioration of the lubricating oil is abruptly caused. It is therefore difficult to maintain the initial performance of the lubricating oil for a long term.

Under conditions for driving an ordinary internal combustion engine, the temperature of a lubricating oil inside its crank case becomes high. Thus, water content incorporated into the lubricating oil as described above, evaporates easily, and the base oil itself of the lubricating oil gives a low solubility of water content. Therefore, the content thereof usually becomes about several tens of ppm by mass. However, water content accumulates in the crank case when the following is performed: the driving in the state that the temperature of the oil is low and water-in-oil does not evaporate easily, for example, the driving from the time when the oil is cool to the time when the oil temperature becomes about 100° C. or higher, the driving for a long term at low temperature, for example, at an oil temperature of 80° C. or lower, the driving in which an engine pauses while idling, or the driving where short-distance running is repeated. About recent lubricating oil, for internal combustion engines, into which a large amount of a dispersing agent such as succinimide is incorporated, water content is easily embraced by the lubricating oil. Thus, the water content by percent in the lubricating oil easily becomes higher than conventional lubricating oil. In particular, in the case where an internal combustion engine using, as a fuel, gasoline, LPG, natural gas or the like in which the amount of water vapor generated by combustion is large, water content is easily condensed by vaporization heat is driven under conditions as described above, the following results are obtained when the water content in the used oil is analyzed: the water content is dissolved and contained in the lubricating oil in an amount of at most 200 to 500 ppm by mass, particularly 1000 ppm or more by mass in the case where the engine is a gas engine and, as the case may be, 10000 ppm by mass, or more. In the case of internal combustion engines for ship, such as outboard engines for motorboats, which are driven over water, lubricating oil is exposed to low-temperature (for example, 50 to 70° C.) and high-humidity conditions, and the conditions are severe conditions against the oxidation deterioration of lubricating oil.

The present inventor has found out that: it is possible for a low-sulfur-content lubricating oil composition in which zinc dithiophosphate, which is excellent in antioxidation and wear prevention, is decreased or is not used in order to restrain the consumption of a metal detergent to restrain the consumption of the metal detergent and improve high-temperature detergency, oxidation stability at high temperature, and others; and further when the sulfur content in fuel used in an internal combustion engine is 50 ppm or less by mass, in particular, 10 ppm or less by mass, the amount of sulfur oxide, which originates from the fuel, incorporated into the lubricating oil is remarkably decreased so that the base number retention property and others of the lubricating oil can be made high (Japanese Patent Application No. 2002-015351).

However, even in such a case in which the amount of strong acid, which originates from sulfur, incorporated into a lubricating oil is remarkably decreased, the following problems become evident under conditions, as described above, that a large amount of water content is present: antioxidation performance and others of a metal detergent, in particular, a salicylate detergent superior in high-temperature detergency and high-temperature oxidation stability are markedly hindered and, as the case may be, precipitation is generated. Thus, it has been desired to solve the problems.

DISCLOSURE OF THE INVENTION

In light of the above-mentioned situation, an object of the present invention is to provide a lubricating oil composition excellent in oxidation stability under the contamination of water content. Another object of the invention is to provide a lubricating oil composition which is also excellent in oxidation stability in the presence of NOx, which is a different cause of the promotion of oxidation deterioration.

The present inventor has paid attention to the structure of salicylate as a metal detergent, and made eager investigations so as to find out that a lubricating oil composition in which a salicylate having a specific structure is incorporated into a lubricant base oil having a specific property makes it possible to improve largely oxidation stability under the contamination of water content. Thus, the present invention has been made.

Accordingly, the present invention is a lubricating oil composition comprising: a lubricant base oil having a sulfur content adjusted to 0.1% or less by mass; and the following (A) and/or (B) incorporated into the base oil in an amount of 0.005 to 5% by mass of the total of the composition, the amount being an amount in terms of the metal element therein:

(A) one or more alkali metal or alkaline earth metal salicylates in which the ratio (or percentage) of a salicylate constituent represented by the following general formula (1) is adjusted to 10% or more by mol, and/or one or more (over) basic salts thereof; and (B) one or more alkali metal or alkaline earth metal salicylates in which the ratio of one or more monoalkylsalicylate constituents is adjusted to 85% or more by mol and the ratio of a monoalkylsalicylate constituent represented by the following general formula (2) is adjusted to 50% or more by mol, and/or one or more (over) basic salts thereof:

(1)

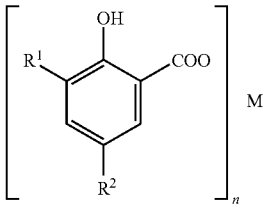

(2)

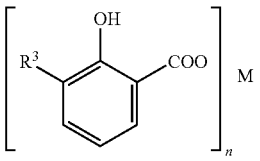

wherein $R^1$ and $R^2$ may be the same or different and each represent a hydrocarbon group having 1 to 40 carbon atoms and the hydrocarbon group may contain oxygen or nitrogen in the general formula (1); $R^3$ represents a secondary alkyl group having 10 or more and less than 20 carbon atoms in the general formula (2); and M represents an alkali metal or alkaline earth metal and n represents 1 or 2 in accordance with the valence number of the metal in the general formulae (1) and (2).

It is preferable that any one of $R^1$ and $R^2$ in the general formula (1) is an alkyl group having 10 to 40 carbon atoms, and the other is a hydrocarbon group which has less than 10 carbon atoms and (may have oxygen or nitrogen).

It is also preferable that anyone of $R^1$ and $R^2$ in the general formula (1) is an alkyl group having 10 or more and less than 20 carbon atoms, and the other is a hydrocarbon group which has less than 10 carbon atoms (may have oxygen or nitrogen).

It is also preferable that the total content of sulfur in the lubricating oil composition of the invention is 0.2% or less by mass.

It is also preferable that the lubricating oil composition of the invention does not contain any zinc dithiophosphate and does not substantially contain any sulfur-containing additive.

The lubricating oil composition of the invention is particularly effective in the case where the composition is used under conditions that the water content in the lubricating oil composition is 200 ppm or more by mass.

The lubricating oil composition of the invention is preferably for an internal combustion engine, and the internal combustion engine is in particular preferably an internal combustion engine in which fuel having a sulfur content of 50 ppm or less by mass is used.

BEST MODES FOR CARRYING OUT OF THE INVENTION

The present invention is described in detail hereinafter.

The lubricant base oil in the lubricating oil composition of the invention is not limited to any especial kind. Any mineral oil type base oil or synthetic type base oil that is used in ordinary lubricating oil may be used.

Specific examples of the mineral oil type base oil include oils obtained by purifying a lubricating oil fraction yielded by distilling an atmospheric residue, which is obtained by distilling crude oil under normal pressure, under reduced pressure by at least one selected from solvent deasphalting, solvent extraction, hydrocracking, solvent dewaxing, hydrorefining and other treatments; wax-isomerized mineral oils; and base oils produced by isomerizing GTL wax (gas-to-liquid wax).

The sulfur content in the mineral oil type base oil is 0.1% or less by mass, preferably 0.05% or less by mass, more preferably 0.005% or less by mass, and in particular preferably 0.002% or less by mass. A low-sulfur lubricating oil composition better in oxidation stability under the contamination of water content can be obtained by decreasing the sulfur content in the mineral oil type base oil.

Specific examples of the synthetic type base oil include polybutene or hydrogenated products thereof; poly-α-olefins, such as 1-octene oligomer and 1-decene oligomer, or hydrogenated products; diesters such as ditridecyl glutarate, di-2-ethylhexyl adipate, diisodecyl adipate, ditridecyl adipate and di-2-ethylhexyl cebacate; polyol esters such as trimethylolpropane caprilate, trimethylolpropane pelargonate, pentaerythritol-2-ethyl hexanoate, and pentaerythritol pelargonate; and aromatic synthesis oils such as alkylnaphthalene, alkylbenzene, and aromatic esters; and mixtures thereof.

In the present invention, one of the above-mentioned mineral oil type oil bases, one of the above-mentioned synthetic type base oils, or any mixture composed of two or more lubricating oils selected therefrom can be used as long as the total sulfur content is adjusted to 0.1% or less by mass. Examples thereof include one or more out of the mineral oil type base oils, one ore more out of the synthetic type base oils, and a mixture of one or more out of the mineral oil type base oils and one or more out of the synthetic type base oils.

The total aromatic fraction content in the lubricant base oil is not particularly limited, and is preferably 10% or less by mass, more preferably 6% or less by mass, even more preferably 3% or less by mass, and particularly preferably 2% or less by mass. A composition better in oxidation stability can be obtained by setting the total aromatic fraction content in the base oil to 10% or less by mass. The above-mentioned total aromatic fraction content means the content of aromatic fractions measured in accordance with ASTM D2549. The aromatic fractions usually include alkylbenzenes, alkylnaphthalenes; anthracene, phenanthlene, and alkylated products thereof; compounds in which 4 or more benzene rings are condensed; compounds having a hetero aromatic, such as pyridines, quinolines, phenols and naphthols; and others.

The kinematic viscosity of the lubricant base oil is not particularly limited, and the kinematic viscosity thereof at 100° C. is preferably 20 $mm^2/s$ or less, more preferably 10 $mm^2/s$ or less to keep the low-temperature viscosity property good. On the other hand, the kinematic viscosity is preferably 1 $mm^2/S$ or more, more preferably 2 $mm^2/s$ or more to form a sufficient oil film at lubricating spots so as to keep the lubricity therein and control the evaporation loss of the lubricant base oil into a low value.

The evaporation loss of the lubricant base oil is 20% or less by mass, more preferably 16% or less by mass, and particularly preferably 10% or less by mass as measured by NOACK evaporation analysis. When the NOACK evaporation loss of the lubricant base oil is kept at 20% or less by mass, the evaporation loss of the lubricating oil can be controlled into a low value. In addition thereto, when the lubricating oil is used as a lubricating oil for internal combustion engines, sulfur compounds, phosphorus compounds or metals in the composition are prevented from being deposited, together with the lubricant base oil, on an exhaust gas purifying device. As a result, it is possible to prevent a bad effect from being produced on the exhaust gas purifying performance. The NOACK evaporation loss referred to herein is a value obtained by keeping 60 g of a lubricating oil sample at 250° C.

and a reduced pressure of 20 $mmH_2O$ (196 Pa) for 1 hour and measuring the evaporation quantity therefrom after the keeping in accordance with CECL-40-T-87.

The viscosity index of the lubricant base oil is not particularly limited, and the value is preferably 80 or more, more preferably 100 or more, and even more preferably 120 or more to obtain superior viscometric property at temperatures from low temperature to high temperature.

The (A) component (s) in the present invention is/are one or more alkali metal or alkaline earth metal salicylates in which the ratio (or percentage) of a salicylate constituent represented by the general formula (1) is adjusted to 10% or more by mol, and/or one or more (over) basic salts thereof.

(1)

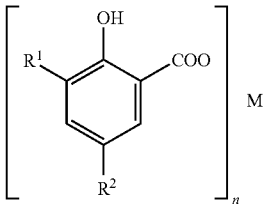

In the general formula (1), $R^1$ and $R^2$ may be the same or different and each represent a hydrocarbon group having 1 to 40 carbon atoms and the hydrocarbon group may contain oxygen or nitrogen. M represents an alkali metal or alkaline earth metal, and is sodium, potassium, calcium, magnesium or the like, preferably calcium or magnesium and particularly desirably calcium. n represents 1 or 2 in accordance with the valence number of the metal.

Examples of the hydrocarbon group having 1 to 40 carbon atoms include alkyl, cycloalkyl, alkenyl, alkyl-substituted cycloalkyl, aryl, alkyl-substituted aryl, and arylalkyl groups. Specific examples thereof include alkyl groups which have 1 to 40 carbon atoms (and may each linear or branched) such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, dococyl, tricocyl, tetracocyl, pentacocyl, hexacocyl, heptacocyl, octacocyl, nonacocyl and triacontyl groups; cycloalkyl groups having 5 to 7 carbon atoms such as cyclopentyl and cyclohexyl groups; alkylcycloalkyl groups having 6 to 10 carbon atoms (the position(s) where the alkyl group(s) is/are substituted on the cycloalkyl group being arbitrary) such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, and methylethylcycloheptyl groups; alkenyl groups (which may be linear or branched, the position of the double bond being arbitrary) such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl and nonadecenyl groups; aryl groups such as phenyl and naphthyl groups; alkylaryl groups having 7 to 10 carbon atoms (in which the alkyl group(s) may be linear or branched, the position(s) where the alkyl group(s) is/are substituted on the aryl group being arbitrary) such as tolyl, xylyl, ethylphenyl, propylphenyl, and butylphenyl groups; and arylalkyl groups which have 7 to 10 carbon atoms (and may be linear or branched) such as benzyl, phenylethyl, phenylpropyl, and phenylbutyl groups.

Especial limitation is not imposed on the combination of $R^1$ with $R^2$. Preferable examples of the combination include the following combinations (1) to (4):

(1) $R^1$ and $R^2$ are the same, and are each a hydrocarbon group having 10 or more and less than 20 carbon atoms, preferably 14 to 18 carbon atoms.

(2) $R^1$ and $R^2$ are the same, and are each a hydrocarbon group having 20 to 40 carbon atoms, preferably 20 to 30 carbon atoms.

(3) One of $R^1$ and $R^2$ is a hydrocarbon group having 10 or more and less than 20 carbon atoms, preferably 14 to 18 carbon atoms, and the other is a hydrocarbon group having less than 10 carbon atoms, preferably less than 5 carbon atoms, particularly preferably 1 carbon atom.

(4) One of $R^1$ and $R^2$ is a hydrocarbon group having 20 to 40 carbon atoms, preferably 20 to 30 carbon atoms, and the other is a hydrocarbon group having less than 10 carbon atoms, preferably less than 5 carbon atoms, particularly preferably 1 carbon atom.

Of these, the above-mentioned (1) or (3) is particularly preferable, and the (3) is most preferable. It is particularly preferable that $R^1$ is a hydrocarbon group having 10 or more and less than 20 carbon atoms and $R^2$ is a hydrocarbon group having less than 10 carbon atoms.

The hydrocarbon group having 10 to 40 carbon atoms is preferably a secondary alkyl group which is derived from a polymer or a copolymer of ethylene, propylene, butylene or the like, or from some other compound and is represented by the following general formula (3):

(3)

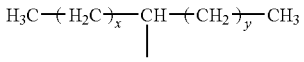

wherein x and y are an integer of 0 to 37 and x+y is from 7 to 37, preferably, x and y are an integer of 0 to 27 and x+y is from 7 to 27, more preferably x and y are an integer of 0 to 16 and x+y is from 7 to 16 or x and y are an integer of 0 to 23 and x+y is from 17 to 23, and particularly preferably x and y are an integer of 0 to 15 and x+y is from 11 to 15.

Examples of the hydrocarbon group having less than 10 carbon atoms include alkyl groups having 1 or more and less than 10 carbon atoms such as methyl, ethyl, butyl and t-butyl. These may contain oxygen or nitrogen, and an example thereof is a —COOH group. Of these, t-butyl and methyl groups are preferable, and a methyl group is most preferable.

The method for producing the (A) component(s) is not particularly limited. Known methods disclosed in Japanese Patent Application Publication (JP-B) No. 48-35325, JP-B No. 50-3082 and others can be used. For example, in the case where one of $R^1$ and $R^2$ is an alkyl group having 10 or more and less than 20 carbon atoms or having 20 to 30 carbon atoms and the other is a methyl group, the (A) component(s) is/are obtained by alkylating the p-position or o-position of o-cresol or p-cresol as a starting material by use of an olefin having 10 or more and less than 20 carbon atoms or having 20 to 30 carbon atoms, next subjecting the resultant to carboxylation, and further causing the resultant carboxylated compound(s) to react with a metal base such as an oxide or hydroxide of an alkali metal or alkaline earth metal, or converting the carboxylated compound (s) once to an alkali metal salt thereof, such as a sodium salt or potassium salt thereof, and then substituting the metal salt to an alkaline earth metal salt.

In the (A) component(s), the ratio of the salicylate constituent represented by the general formula (1) is 10% or more by mol, preferably 20% or more by mol, more preferably 40% or more by mol, and most preferably 100% by mol. It is particularly preferable that the ratio of the salicylate constituent of the (1) or (3), or the (3) is 10% or more by mol. Examples of the salicylate which is contained in the (A) component(s) and is different from the salicylate represented by the general formula (1) include monoalkylsalicylates having an alkyl group having 1 to 40 carbon atoms, such as 3-alkylsalicylate, 4-alkylsalicylate, and 5-alkylsalicylate. The ratio of these constituents is not limited, and the constituents usually correspond to the remaining fractions of the compounds represented by the general formula (1).

The (B) component(s) in the lubricating oil composition of the present invention is/are one or more alkali metal or alkaline earth metal salicylates in which the ratio of one or more monoalkylsalicylate constituents is adjusted to 85% or more by mol and the ratio of a monoalkylsalicylate constituent represented by the general formula (2) is adjusted to 50% or more by mol, and/or one or more (over) basic salts thereof.

(2)

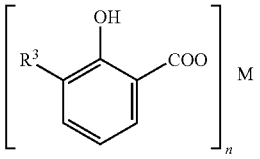

In the general formula (2), $R^3$ represents a secondary alkyl group having 10 or more and less than 20 carbon atoms, and M represents an alkali metal or alkaline earth metal, and is sodium, potassium, calcium, magnesium or the like, preferably calcium or magnesium and particularly desirably calcium. n represents 1 or 2 in accordance with the valence number of the metal.

Examples of the secondary alkyl group having 10 or more and less than 20 carbon atoms include secondary decyl, undecyl, dodecyl, tridecyl, tetradecyl, pentadecyl, hexadecyl, heptadecyl, octadecyl, and nonadecyl groups. The alkyl group is a secondary alkyl group which has 10 or more and less than 20 carbon atoms, preferably 14 to 18 carbon atoms and is derived from a polymer or copolymer of ethylene, propylene, butylene or the like, or from some other compound. The secondary alkyl group referred to herein has the same meaning as the secondary alkyl group in the above-mentioned item of the (A) component (s)

The method for producing the (B) component(s) is not particularly limited, and can be obtained by using any known method for producing a monoalkylsalicylate and adjusting the ratio of the monoalkylsalicylate constituent(s) to 85% or more by mol. In order to set the ratio of the salicylate (3-alkylsalicylate) constituent of the general formula (2) to 50% or more by mol, specifically, for example, the following is caused to react with a metal base such as an oxide or hydroxide of an alkali metal or alkaline earth metal, or the following is once converted to an alkali metal salt thereof, such as a sodium salt or potassium salt thereof, and then substituting the salt to an alkaline earth metal salt: a compound obtained by alkylating the ortho position of phenol as starting material selectively by use of an equivalent amount of an olefin having 10 or more and less than 20 carbon atoms, preferably 14 to 18 carbon atoms, and next subjecting the resultant to carboxylation; a compound obtained by alkylating the 3-position of salicylic acid selectively by use of the above-mentioned olefin; a compound obtained by isolating a 3-alkylsalicylic acid selectively from a mixture made mainly of monoalkylsalicylic acids, and then concentrating the isolated acid; or a compound obtained by adding the above-mentioned high-concentration 3-alkylsalicylic acid to a monoalkylsalicylic acid mixture so as to set the ratio of the 3-alkylsalicylic acid constituent to 50% or more by mol.

About the (B) component(s) obtained as described above, besides the salicylate represented by the general formula (2) (3-alkylsalicylate having a secondary alkyl group having 10 or more and less than 20 carbon atoms), the following are usually obtained as byproducts: 4-alkylsalicylate, 5-alkylsalicylate, 3,5-dialkylsalicylate, 5-alkyl 4-hydroxyisophtalate and other salicylates, which each have an alkyl group having 10 or more and less than 20 carbon atoms. The total ratio of the monoalkylsalicylate constituent(s) (3-alkylsalicylate, 4-alkylsalicylate, 5-alkylsalicylate, and others, which each have a secondary alkyl group having 10 or more and less than 20 carbon atoms) is 85% or more by mol, preferably 90% or more by mol, and most preferably 100% by mol. The ratio of the constituent(s) may be 96% or less by mol from the viewpoint of production costs. The ratio of the salicylate represented by the general formula (2) is 50% or more by mol, preferably 55% or more by mol, more preferably 60% or more by mol, even more preferably 80% or more by mol, and most preferably 100% by mol. The ratio of the constituent may be 96% or less by mol from the viewpoint of production costs.

The monoalkylsalicylates having an alkyl group having 10 or more and less than 20 carbon atoms are better than monoalkylsalicylates having an alkyl group having 20 to 40 carbon atoms in oxidation stability under the contamination of water content, and are better than monoalkylsalicylates having an alkyl group having 1 or more and less than 10 carbon atoms in oil solubility. In the case where the ratio of the salicylate constituent represented by the general formula (2) in the (B) component(s) is set to 50% or more by mol, the oxidation stability thereof under the contamination of water and the oil solubility are better in the case where the ratio is set to less than 50% by mol.

The (A) component(s) and the (B) component(s) in the invention contain not only the neutral salts obtained as described above but also basic salts obtained by heating these neutral salts and an excessive amount of an alkali metal or alkaline earth metal salt or an alkali metal or alkaline earth metal base (a hydroxide or oxide of an alkali metal or alkaline earth metal) in the presence of water and perbasic salts obtained by causing the neutral salts to react with a base, such as a hydroxide of an alkali metal or alkaline earth metal, in the presence of carbon dioxide, boric acid, or borate.

Usually, these reactions are conducted in a solvent (such as an aliphatic hydrocarbon solvent such as hexane; an aromatic hydrocarbon solvent such as xylene; or a light lubricant base oil). (Per)basic salts in which the content of their metal is from 1.0 to 20% by mass, preferably from 2.0 to 16% by mass are obtained.

About the (A) component(s) or the (B) component(s) in the invention, the metal ratio thereof is not particularly limited, and is usually 20 or less, preferably 5 or less. The component (s) is/are preferably one or more salicylates in which the metal ratio is preferably 2.3 or less, more preferably 1.5 or less, and even more preferably 1.3 or less in order to improve the oxidation stability further under the contamination of water content. In this case, one or a mixture of two or more out of neutral, basic and perbasic salicylate detergents may be used as long as the metal ratio thereof is 2.3 or less. The metal ratio referred to herein is represented by (the valence number of the metal element in alkali metal or alkaline earth salicylate)×(the metal element content (% by mol))/(the soap-group content (% by mol)) in which the metal element means calcium, magnesium or the like, and the soap-group content means the group of alkylsalicylic acid.

In the lubricating oil composition of the invention, the (A) component(s) and the (B) component(s) may be used together. When the (A) component(s) and the (B) component(s) may be used together, a synergetic effect for the improvement in oxidation stability under the contamination of water content can be evidently recognized. About the blend ratio between the (A) component(s) and the (B) component(s), it is advisable to mix them so as to set the ratio of the salicylate represented by the general formula (1) to 10% or more by mol, preferably 25% or more by mol, and more preferably 40% or more by mol. It is desired that the total constituent ratio of the salicylate represented by the general formula (1), in particular the salicylate in which one of $R^1$ and $R^2$ is a hydrocarbon group having 10 to 40 carbon atoms and the other is a hydrocarbon group having less than 10 carbon atoms, and the salicylate represented by the general formula (2) is preferably 60% or more by mol, more preferably 65% or more by mol, even more preferably 70% or more by mol, and particularly preferably 80% or more by mol. It appears that this is because the ratio of the salicylate constituent represented by the general formula (1) increases and the ratio of the 5-alkylsalicylate constituent among the monoalkylsalicylates which mainly constitute the (B) component(s) decreases. That is, it appears that the lubricating oil composition into which salicylates where the constituent ratio of the salicylate having an alkyl group at least in the 3-position thereof, in particular a secondary alkyl group having 10 or more and less than 20 therein, is high are incorporated makes it possible to improve the oxidation stability further under the contamination of water content. If the total ratio of the salicylate constituents having a hydrocarbon group at least in the 3-position is 65% or more by mol, preferably 70% or more by mol and particularly preferably 80% or more by mol even in the case where the salicylate constituents are salicylates having a hydrocarbon group having 20 or more carbon atoms, the oxidation stability under the contamination of water content can be similarly improved.

In the lubricating oil composition of the invention, the lower limit of the content by percentage of the (A) component(s) and/or the (B) component(s) is 0.005% by mass, preferably 0.01% by mass, and more preferably 0.02% by mass of the total of the composition, the lower limit being a lower limit in terms of the metal element therein, in order to obtain a sufficient antioxidation effect under the contamination of water content. The upper limit thereof is 5% by mass, preferably 1% by mass, more preferably 0.5% by mass, even more preferably 0.3% by mass, particularly preferably 0.15% by mass, and more particularly preferably 0.1% by mass in order to obtain the effect corresponding to the blended amount thereof.

The lubricating oil composition of the invention is a lubricating oil composition in which the (A) component(s) and/or the (B) component(s) is/are incorporated into a lubricant base oil having a sulfur content adjusted to 0.1% or less by mass. In order to improve the performance thereof further or improve other necessary performances, one or more additives selected from known additives may be arbitrarily incorporated into the composition, examples of the known additives including an antioxidant, an ashless dispersant, an anti-wear agent, metal detergents other than the (A) component(s), a friction modifier, a viscosity index improver, a corrosion inhibitor, a rust inhibitor, an anti-emulsifier, a metal inactivator, an antifoamer, and a colorant.

As the antioxidant, any antioxidant that is ordinarily used in lubricating oils may be used, examples of which include a phenol type antioxidant, an amine type antioxidant, and a metal type antioxidant. Since the antioxidation performance of the lubricating oil composition is made higher by the addition of the antioxidant, the effect for improving the oxidation stability under the contamination of water content or the base number retention property and high-temperature detergency can be made still higher.

Preferable examples of the phenol type antioxidant include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol, 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl) sulfide, 2,2'-thio-diethylenebis[3-(3,5-di-tert-butyl-4-hydroxypheny 1)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octadecyl-3-(3,5-di-tert-butyl-4-hydroxyphenyl)propionate, octyl-3-(3,5-di-tert-butyl-4-hydroxyphenyl)propionate, and 3-methyl-5-tert-butyl-4-hydroxyphenyl-substituted aliphatic acid esters. These may be used in the form of a mixture of two or more thereof.

Examples of the amine type antioxidant include phenyl-α-naphthylamine, alkylphenyl-α-naphthylamine, and dialkyldiphenylamine. These may be used in the form of a mixture of two or more thereof. The amine type antioxidant may be combined with the above-mentioned phenol type antioxidant.

When the antioxidant is incorporated into the lubricating oil composition of the invention, the content thereof by percentage is usually 5.0% or less by mass, preferably 3.0% or less by mass, and more preferably 2.5% or less by mass of the total of the lubricating oil composition in order to obtain a sufficient antioxidation effect corresponding to the blended amount thereof. On the other hand, the content thereof by percentage is preferably 0.1% or more by mass, preferably 1% or more by mass of the total of the lubricating oil composition in order to heighten the oxidation stability further under the contamination of water content.

Examples of the ashless dispersant include succinimide type ashless dispersants, benzylamine type ashless dispersants, polybutenylamine type ashless dispersants, and compounds modified with a boron compound, an oxygen-containing organic compound, a phosphorus compound, a sulfur compound or the like.

Examples of the anti-wear agent include sulfur-containing compounds such as zinc dithiophosphate, zinc dithiocarbamate, disulfides, olefin sulfides, and oil and fat sulfides; and phosphites and phosphates, and metal or amine salts thereof.

Examples of the metal detergents other than the (A) component(s) include alkali metal or alkaline earth metal sulfonates and phenates.

Examples of the friction modifier include molybdenum dithiophosphate, molybdenum dithiocarbamate, aliphatic acid esters, aliphatic amines, aliphatic acid amides, and aliphatic ethers.

Specific examples of the viscosity index improver include the so-called non-dispersion type viscosity index improvers, which are polymers, copolymers made from one monomer or two or more monomers selected from various methacrylic acid esters, or hydrogenated products thereof; the so-called dispersion type viscosity index improvers, which are obtained by copolymerizing them further with various methacrylic acid esters containing a nitrogen compound; non-dispersion type or dispersion type ethylene-α-olefin copolymers (examples of the α-olefin including propylene, 1-butene and 1-pentene), or hydrogenated products thereof; polyisobutylene, or hydrogenated products thereof; hydrogenated products of styrene-diene copolymer; styrene-anhydrous maleic acid ester copolymer; and polyalkylstyrene.

It is necessary that the molecular weight of these viscosity index improvers is selected, considering shear stability. Specifically, the number-average molecular weight of the viscosity index improvers is usually from 5,000 to 1,000,000, preferably from 100,000 to 900,000 in the case of, for example, the dispersion type and the non-dispersion type polyacrylates; is usually from 800 to 5,000, preferably from 1,000 to 4,000 in the case of the polyisobutylene or the hydrogenated products thereof; and is usually from 800 to 500,000, preferably from 3,000 to 200,000 in the case of the ethylene-α-olefin copolymers or the hydrogenated products thereof.

In the case where the ethylene-α-olefin copolymers or the hydrogenated products thereof are used out of these viscosity index improvers, lubricating oil compositions particularly excellent in shear stability can be obtained. One compound or two or more compounds selected at will from the above-mentioned viscosity index improvers can be contained in an arbitrary amount. The content by percentage of the viscosity index improver(s) is usually from 0.1 to 20.0% by mass of the lubricating oil composition.

Examples of the corrosion inhibitor include benztriazole type, tolyltriazole type, thiadiazole type, and imidazole type compounds.

Examples of the rust inhibitor include petroleum sulfonate, alkylbenzenesulfonate, dinonylnaphthalenesulfonate, alkenylsuccinic acid esters, and polyhydric alcohol esters.

Examples of the anti-emulsifier include polyalkylene glycol type nonionic surfactants such as polyoxyethylene alkyl ether, polyoxyethylene alkyl phenyl ether and polyoxyethylene alkyl naphthyl ether.

Examples of the metal inactivator include imidazolin, pyrimidine derivatives, alkylthiadiazole, mercaptobenzothiazole, benzotriazole or derivatives thereof, 1,3,4-thiadiazole polysulfide, 1,3,4-thiazolyl-2,5-bisdialkyldithiocarbamate, 2-(alkyldithio)benzimidazole, and β-(o-carboxybenzylthio) propionitrile.

Examples of the antifoamer include silicone, fluorosilicone, and fluoroalkyl ether.

When these additives are incorporated into the lubricating oil composition of the invention, the content thereof by percentage is usually selected from the range of 0.005 to 5% by mass of the total of the lubricating oil composition in the case of the corrosion inhibitor, the rust inhibitor or the antiemulsifier; from the range of 0.005 to 1% by mass thereof in the case of the metal inactivator; and from the range of 0.0005 to 1% by mass thereof in the case of the antifoamer.

In the lubricating oil composition of the invention, the total sulfur content is set preferably to 0.2% or less by mass, more preferably to 0.1% or less by mass, and even more preferably to 0.05% or less by mass by decreasing the sulfur content in the lubricant base oil or decreasing the content of the sulfur-containing additive(s), such as zinc dithiophosphate, among the above-mentioned additives, or by incorporating none of the sulfur-containing additive(s). In particular, the content of the sulfur-containing additive(s) including zinc dithiophosphate, which undergoes self-decomposition or oxidation deterioration to generate a strong acid, such as sulfuric acid, thereby damaging the oxidation stability under the contamination of water content, is set preferably to 0.15% or less by mass, more preferably to 0.1% or less by mass, and particularly preferably to about 0, the content being an amount in terms of the sulfur element therein. In this case, it is possible to obtain a lubricating oil composition having a total sulfur content of 0.01% or less by mass or 0.001% or less by mass, or a lubricating oil composition which does not substantially contain sulfur.

The lubricating oil composition of the invention is effective in the case where the composition is used in the state of the contamination of water content therein. Such a state can be verified by collecting the lubricating oil in use and then measuring the water content in the lubricating oil. Specifically, the lubricating oil composition is effective under conditions that the water content in the lubricating oil becomes 200 ppm or more by mass, preferably 300 ppm or more by mass, more preferably 500 ppm or more by mass, even more preferably 1000 ppm or more by mass, and particularly preferably 3000 ppm or more by mass. The water content in the lubricating oil referred to herein means the water content measured by the method prescribed in JISK2275-5 "Karl Fischer Coulometric Titration Method" (using a water content vaporizing device).

It has been proved that the lubricating oil composition of the invention is excellent in oxidation stability under the contamination of water content and exhibits high-temperature detergency and excellent oxidation stability even in the atmosphere of NOx. Accordingly, the lubricating oil composition of the invention can be preferably used as a lubricating oil for internal combustion engines, such as gasoline engines, diesel engines and gas engines for motorcycles, automobiles, power generation and ships. Furthermore, the lubricating oil composition is a low-sulfur lubricating oil; therefore, the lubricating oil composition is particularly effective for internal combustion engines into which an exhaust gas purifying catalyst is fitted. Also, the composition can be preferably used as a lubricating oil for internal combustion engines of ships, such as outboard motors for motorboats, which are driven on the water under low oil temperature and high humidity conditions. The composition can be particularly preferably used as a lubricating oil for internal combustion engines using a low sulfur fuel, such as gasoline, light oil, kerosene, LPG or natural gas having a sulfur content of 50 ppm or less by mass, preferably 30 ppm or less by mass and particularly preferably 10 ppm or less by mass, or for internal combustion engines using hydrogen, dimethyl ether, alcohol, or GTL (gas-to-liquid) fuel which does not substantially contain any sulfur content, that is, internal combustion engines in which the amount of sulfur oxide which results from a fuel, and is incorporated into a lubricating oil is remarkably reduced; in particular, as a lubricating oil for gas engines.

The lubricating oil composition of the invention can be preferably used as a lubricant the oxidation stability of which is desired to be improved as described above, such as lubricating oil for systems for driving an automatic or manual transmission driving mechanism or the like, grease, wet-type brake, oil pressure hydraulic oil, turbine oil, compressor oil, shaft bearing oil, refrigerating machine oil, or the like.

EXAMPLES

The following describes the content of the invention more specifically by way of Examples and Comparative Examples. However, the invention is not limited by these examples.

Examples 1 to 6, and Comparative Example 1

Lubricating oil compositions of the invention (Examples 1 to 6) and a lubricating oil composition for comparison (Comparative Example 1) were each prepared, as shown in Table 1. Each calcium salicylate used herein was calcium salicylate obtained by removing oil contents and unreacted products or impurities (such as phenol, cresol, olefins, and water) generated at the time of synthesizing the salicylate beforehand by dialysis with a rubber membrane or some other method. The compositions of the invention were each prepared so as to set the water content therein to 100 ppm or less by mass by heating each of these calcium salicylates together with a lubricant base oil and stirring the mixture at 100° C. for 1 hour.

TABLE 1

| Based on the total amount of the composition | Example 1 | Example 2 | Example 3 | Example 4 | Example 5 | Example 6 | Comparative Example 1 |
|---|---|---|---|---|---|---|---|
| Lubricant base oil *1) | 99.0 | 99.0 | 99.0 | 99.0 | 99.0 | 99.0 | 99.0 |
| % by mass | | | | | | | |
| Calcium salicylate | A | B | C | D | E | F | G |
| content | 1.0 | 1.0 | 1.0 | 1.0 | 1.0 | 1.0 | 1.0 |
| Amount in terms of the metal | (0.05) | (0.04) | (0.05) | (0.05) | (0.05) | (0.04) | (0.04) |
| element therein | | | | | | | |
| Total sulfur content (in the total | 0.001 | 0.001 | 0.001 | 0.001 | 0.001 | 0.001 | 0.001 |
| of the composition) % by mass | | | | | | | |

*1) Hydrorefined mineral oil

Content of all aromatic fractions: 1.2% by mass, sulfur content: 10 ppm by mass, 100° C. kinematic viscosity: 5.6 $mm^2/s$, viscosity index: 125, and NOACK evaporation loss: 8% by mass Table 2 shows the calcium content, alkyl groups, the salicylic acid structure, and others of the calcium salicylate(s) incorporated into each of the compositions.

TABLE 2

| | | Calcium salicylate | | | | | | |
|---|---|---|---|---|---|---|---|---|
| | | A | B | C | D | E | F | G |
| Calcium content | % by mol | 5.2 | 4.3 | 5.2 | 5.2 | 5.2 | 4.3 | 4.3 |
| Alkyl group | | Secondary C14, 16, 18 | Secondary C20, 22, 24, 26 | Secondary C14, 16, 18 | Secondary C14, 16, 18 | Secondary C14, 16, 18 | Secondary C20, 22, 24, 26 | Secondary C20, 22, 24, 26 |
| Metal ratio | | 1 | 1 | 1 | 1 | 1 | 1.1 | 1.2 |
| Salicylic acid structure | | | | | | | | |
| 3-Alkyl-5-methyl-salicylic acid | % by mol | 100 | 100 | | | 50 | 30 | |
| 3-Alkylsalicylic acid | % by mol | | | 100 | 63 | 32 | 39 | 55 |
| 3,5-Dialkylsalicylic acid | % by mol | | | | 3 | 1 | 2 | 3 |
| 5-Alkyl-4-hydroxy-isophthalic acid | % by mol | | | | 2 | 1 | 2 | 3 |
| 4-Alkylsalicylid acid | % by mol | | | | 4 | 2 | 3 | 5 |
| 5-Alkylsalicylic acid | % by mol | | | | 28 | 14 | 24 | 34 |
| Total of monoalkyl-salicylic acids | % by mol | 0 | 0 | 100 | 95 | 48 | 66 | 94 |
| Salicylic acid having a substituent in the 3-position | % by mol | 100 | 100 | 100 | 68 | 84 | 73 | 61 |
| Salicylic acid having a substituent in the 3- and 5-positions | % by mol | 100 | 100 | 0 | 5 | 52 | 34 | 6 |
| Notes | | | | | | Mixing A with D (5:5) | Mixing B with G (3:7) | |

The oxidation life of each of the resultant compositions was measured with a device prescribed in "Rotary Bombe System Oxidation Stability Test Method" (RBOT) prescribed in JISK2514-6 under the same conditions as prescribed in the above-mentioned method except the condition (1) that water content was not substantially present (no water was added to the sample and the bombe), and the condition (2) that water content was excessively supplied (no water was added to the sample but 5 mL of water was added to the bombe: 10% by mass of water in 100% by mass of the sample (100,000 ppm by mass)).

Under the condition (1), the oxidation life was in the range of 510 to 590 minutes even if any one of the salicylates was used. Thus, excellent oxidation stability was exhibited.

Under the condition (2), the system was pressured into 620 kPa with oxygen at 25° C., and subsequently the system was heated to 150° C. Accordingly, water content was present as pressured water vapor of 150° C. temperature in the system so as to turn into a state of contacting the sample sufficiently. Thus, the following condition was reproduced: the condition that a large amount of water resulting from burning in an internal combustion engine was incorporated into a crank case and further the water content remained and accumulated in the crank case. The water content was dissolved in the sample in a saturation state or supersaturation state. Thus, it can be considered that under the present test conditions the oxidation life of each of the lubricating oils containing at least 200 ppm or more by mass of water content was measured. The test results are shown in Table 3

TABLE 3

| | Example 1 | Example 2 | Example 3 | Example 4 | Example 5 | Example 6 | Comparative Example 1 |
|---|---|---|---|---|---|---|---|
| RBOT life Water 100,000 ppm by mass min | 265 | 144 | 187 | 115 | 258 | 100 | 40 |

As is evident from Table 3, the following is understood: in the case of using monoalkylsalicylates having alkyl groups having 20 or more carbon atoms (Comparative Example 1), the oxidation life was only 40 minutes and got worse by 90% or more under the contamination of water content as described above than under the condition that water content was not substantially contained. Thus, it is understood that the salicylates do not exhibit antioxidation performance easily under the contamination of water content. On the other hand, in the lubricating oil compositions of the invention using the (A) component (Examples 1 and 2), in the cases of using the (B) component(s) (Examples 3 and 4), in the case of using the (A) component and the (B) components together (Example 5), and in the case of using the (A) component together with monoalkylsalicylates having alkyl groups having 20 or more carbon atoms (Example 6), the oxidation lives thereof were made about 2 to 7 times as good as oxidation life of the composition of Comparative Example 1. In particular, when attention was paid to the salicylates having the same structure so as to make comparison, it is understood that in the case of using salicylates having alkyl groups having 14 or more and less than 20 carbon atoms (Examples 1, 3, 4 and 5), the oxidation lives thereof under the contamination of water content were remarkably better than in the case where salicylates having alkyl groups having 20 or more carbon atoms (Examples 2 and 6, and Comparative Example 1). In the composition of Example 5, the content of the calcium salicylate A and that of the calcium salicylate D were each 1/2; however, the result was substantially equivalent to the result of Example 1 using the calcium salicylate A. Thus, it is understood that synergetic effect was obtained. It appears that this is because the total constituent ratio of the (A) component (3-alkyl-5-methylsalicylate) and the (B) component (3-alkylsalicylate) (all of the alkyl groups therein: secondary C14 to C18) was a high value of 84% by mol, and the constituent ratio of 5-alkylsalicylate was low (14% by mol). About the composition in which the constituent ratio of the calcium salicylate (B) is adjusted to be 30% by mol of the calcium salicylate G of which oxidation life under the contamination of water content is short (Example 6: the total constituent ratio of the (A) component and 3-alkylsalicylate was 73% by mol), the oxidation life thereof was evidently improved. Thus, it is clear that the oxidation life of monoalkylsalicylates under the contamination of water content can be improved regardless of the number of carbons in their alkyl groups by incorporating a small amount of the (A) component.

It has been proved that when 3,5-dialkylsalicylate was used as the component (A) in the same way, the oxidation life thereof under the contamination of water content was able to be improved as compared with that of the composition of Comparative Example 1.

It has been proved that the lubricating oil composition of the invention, particularly the lubricating oil composition containing one or more (A) components (for example, the composition of Example 2) was better than the composition of Comparative Example 1 in the performance of restraining an increase in the total acid value in a NOx blowing in test (150° C., NOx: 1198 ppm). (Total acid value from initial oil stage to the time when 25 hours passed; Example 2: from 1.0 to 1.4 mgKOH/g, and Comparative Example 1: from 1.0 to 1.8 mgKOH/g)

In the case where zinc dithiophosphate was incorporated into each of the lubricating oil compositions of the invention, the oxidation life thereof was improved as compared with the case that zinc dithiophosphate was incorporated into the composition of Comparative Example 1, but was shorter than that of the composition into which no dithiophosphate was incorporated. It is therefore preferable that a sulfur-containing additive such as dithiophosphate is not incorporated.

INDUSTRIAL APPLICABILITY

The lubricating oil composition of the invention is excellent in oxidation stability under the contamination of water content, and is also excellent in oxidation stability in the presence of NOx. Thus, the lubricating oil composition can be preferably used as a lubricating oil for internal combustion engines such as a gasoline engine, a diesel engine or a gas engine for two-wheeled vehicles, four-wheeled vehicles, power generation, ship and others. Moreover, the lubricating oil composition is particularly suitable for internal combustion engines to which an exhaust gas purifying catalyst is fitted since the composition is a low-sulfur lubricating oil. Additionally, the advantageous effects thereof can be further exhibited when the lubricating oil composition is particularly favorably used as a lubricating oil for internal combustion engines using low-sulfur fuel having a sulfur content of 50 ppm or less by mass, that is, internal combustion engines in which the contamination of sulfur oxide into lubricating oil is largely decreased, in particular gas engines.

The lubricating oil composition of the invention can be preferably used as a lubricant the oxidation stability of which is desired to be improved as described above, such as lubricating oil for systems for driving an automatic or manual change gear or the like, grease, wet-type brake, oil pressure hydraulic oil, turbine oil, compressor oil, shaft bearing oil, refrigerating machine oil, or the like.

The invention claimed is:

1. A lubricating oil composition, comprising: a lubricant base oil having a sulfur content adjusted to 0.1% or less by mass; and the following (A) incorporated into the base oil in an amount of 0.005 to 0.5% by mass of the total of the composition, the amount being an amount in terms of the metal element therein:

(A) one or more alkali metal or alkaline earth metal salicylates in which the ratio (or percentage) of a salicylate constituent represented by the following general formula (1) is adjusted to 10% or more by mol, and/or one or more (over)basic salts thereof:

(1)

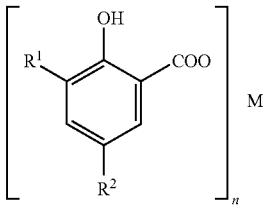

wherein either one of $R^1$ and $R^2$ in the general formula (1) is an alkyl group which has 10 to 40 carbon atoms, and the other is a hydrocarbon group which has less than 5 carbon atoms (and may contain oxygen or nitrogen); and M represents an alkali metal or alkaline earth metal and n represents 1 or 2 in accordance with the valence number of the metal in the general formula (1).

2. The lubricating oil composition according to claim 1, comprising: the lubricant base oil having a sulfur content adjusted to 0.1% or less by mass; and the (A) incorporated into the base oil in an amount of 0.005 to 0.5% by mass of the total of the composition, the amount being an amount in terms of the metal element therein, wherein the total ratio of the salicylate constituents having the alkyl group at least at the 3-position in all salicylate constituents contained in the lubricating oil is 65% or more by mol.

3. The lubricating oil composition according to claim 1, wherein the total sulfur content of the composition is 0.2% or less by mass.

4. The lubricating oil composition according to claim 1, which contains no zinc dithiophosphate.

5. The lubricating oil composition according to claim 1, which does not contain any sulfur-containing additive substantially.

6. A process for using the lubricating oil composition according to claim 1, comprising at least the step of using conditions wherein the water content in the lubricating oil becomes 200 ppm or more by mass.

7. A process for using the lubricating oil composition according to claim 1, comprising at least the step of using an internal combustion engine.

8. A process for using the lubricating oil composition according to claim 7, comprising at least the step of using an internal combustion engine wherein the internal combustion engine uses fuel having a sulfur content of 50 ppm or less by mass.

9. A method for improving the oxidation life of a lubricating oil composition according to claim 2, comprising at least the step of using conditions wherein the water content in the composition becomes 200 ppm or more by mass.

10. The lubricating oil composition according to claim 1, wherein either one of $R^1$ and $R^2$ in the general formula (1) is an alkyl group which has 10 or more and less than 20 carbon atoms, and the other is a hydrocarbon group which has less than 5 carbon atoms (and may contain oxygen or nitrogen).

* * * * *